US009173484B2

(12) United States Patent
Miller et al.

(10) Patent No.: US 9,173,484 B2
(45) Date of Patent: Nov. 3, 2015

(54) READY-TO-ASSEMBLE TABLE

(71) Applicant: Sauder Woodworking, Archbold, OH (US)

(72) Inventors: Mark V. Miller, Archbold, OH (US); Douglas P. Krieger, Archbold, OH (US)

(73) Assignee: Sauder Woodworking, Archbold, OH (US)

( * ) Notice: Subject to any disclaimer, the term of this patent is extended or adjusted under 35 U.S.C. 154(b) by 0 days.

(21) Appl. No.: 14/201,190

(22) Filed: Mar. 7, 2014

(65) Prior Publication Data

US 2014/0283716 A1 Sep. 25, 2014

Related U.S. Application Data

(60) Provisional application No. 61/803,921, filed on Mar. 21, 2013.

(51) Int. Cl.

| | |
|---|---|
| ***A47B 3/00*** | (2006.01) |
| ***A47B 13/08*** | (2006.01) |
| *A47B 83/04* | (2006.01) |

(52) U.S. Cl.

CPC ..... *A47B 13/088* (2013.01); *A47B 83/045* (2013.01)

(58) Field of Classification Search

CPC ..... A47B 3/10

USPC ..... 108/34, 38, 157.1, 153.1, 156, 157.16, 108/157.18, 158.12

See application file for complete search history.

(56) References Cited

U.S. PATENT DOCUMENTS

| | | | | | |
|---|---|---|---|---|---|
| 426,231 | A | * | 4/1890 | Bosworth | 108/158.12 |
| 873,855 | A | * | 12/1907 | Goldin | 108/38 |
| 1,060,295 | A | * | 4/1913 | Stiles | 108/34 |
| 1,533,494 | A | * | 4/1925 | Billburg | 108/34 |
| 1,626,293 | A | * | 4/1927 | Mason | 108/34 |
| D142,262 | S | * | 8/1945 | Paden | 108/38 |
| 2,447,141 | A | * | 8/1948 | Shillady | 108/34 |
| 2,652,300 | A | * | 9/1953 | Graber et al. | 108/34 |
| 2,677,470 | A | * | 5/1954 | Catalano | 108/34 |
| 2,686,096 | A | * | 8/1954 | Barnes, Jr. | 108/158.12 |
| 2,805,707 | A | * | 9/1957 | Schoeppner | 108/38 |
| 4,231,453 | A | * | 11/1980 | Minor | 190/11 |
| 6,032,590 | A | * | 3/2000 | Chen | 108/158.12 |

* cited by examiner

*Primary Examiner* — Jose V Chen

(74) *Attorney, Agent, or Firm* — McGarry Bair PC

(57) ABSTRACT

A ready-to-assemble table comprises a split tabletop having separable portions, an apron depending from the tabletop portions, and legs mountable to the tabletop portions to support the tabletop on a surface. When the table is disassembled, the tabletop portions with their respective aprons can be stacked and arranged so that the aprons space the tabletop portions to form a cavity therebetween sized to receive the legs for packaging of the table. Additionally, a partial table can be constructed employing one of the tabletop portions for retail display.

16 Claims, 6 Drawing Sheets

READY-TO-ASSEMBLE TABLE

CROSS REFERENCE TO RELATED APPLICATIONS

This application claims priority to and claims the full benefits of U.S. Application Ser. No. 61/803,921 filed Mar. 21, 2013, entitled Ready-to-Assemble Table.

BACKGROUND

Ready-to-assembly (RTA) furniture, also known as knock-down furniture or flat pack furniture, is a type of furniture sold in multiple pieces requiring assembly. The pieces are packed in one or more boxes with assembly instructions and hardware. RTA furniture is popular among consumers wishing to save money by assembling the product on their own and foregoing expensive furniture delivery service. In addition to economic benefits, RTA furniture is often easy to assemble with the use of simple tools.

SUMMARY

A ready-to-assemble table according to one embodiment of the invention comprises a split tabletop having first and second separable portions, an apron depending from each of the first and second tabletop portions, and legs mountable to the first and second tabletop portions to support the tabletop on a surface. When the table is in a disassembled condition, the separated first and second tabletop portions with their respective aprons can be stacked with one of the first and second tabletop portions inverted so that the aprons space the first and second tabletop portions to form a cavity therebetween sized to receive the legs for packaging of the table.

A table according to another embodiment of the invention comprises a first partial table comprising a first tabletop and a pair of legs mounted to the first tabletop, a second partial table separate from the first partial table and comprising a second tabletop and a pair of legs mounted to the second tabletop, and a fastener mounted to the first and second tabletops and selectively actuable to couple the first and second tabletops to form an assembled full table.

DESCRIPTION OF EMBODIMENTS OF THE INVENTION

The invention relates to a table supplied to a user in a disassembled condition for assembly by the user, a so-called ready-to-assemble or knock-down table. In general, ready-to-assemble furniture comprises several components that are packaged into a container individually (i.e., not assembled to any other components of the table), as subassemblies (i.e., two or more components pre-assembled), or a combination thereof.

Figure 1:
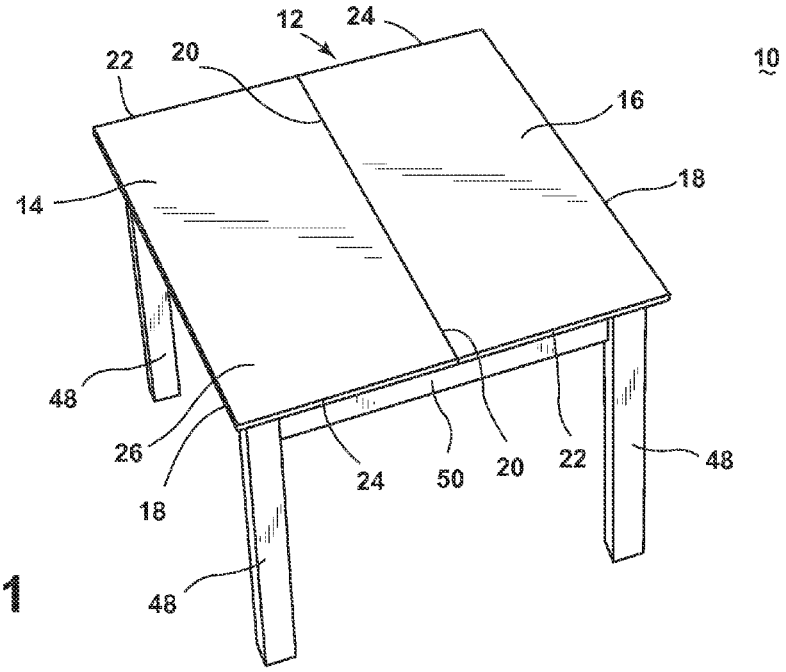
FIG. 1 is a perspective view of a ready-to-assemble table according to one embodiment of the invention having a split tabletop.

Referring to FIG. 1, a table 10 according to one embodiment of the invention includes a tabletop 12 split into multiple portions, in this case a first portion 14 and a second portion 16. While the present embodiment includes two portions forming the split tabletop 12, the tabletop 12 can comprise any suitable number of portions. Each of the first and second portions 14, 16 of the exemplary tabletop 12 of FIG. 1 has a perimeter defined by an end edge 18, a mating edge 20 generally parallel to and opposite the end edge 18, and a pair of opposing side edges 22, 24 joining the end edge 18 and the mating edge 20. The side edges 22, 24 are approximately half the length of the end and mating edges 18, 20 such that the tabletop 12 has a generally square configuration when the table 10 is assembled with the generally rectangular first and second portions 14, 16 in abutting contact along the respective mating edges 20. The tabletop 12, however, may have any suitable shape, including shapes with arcuate and irregular edges.

Figure 2:
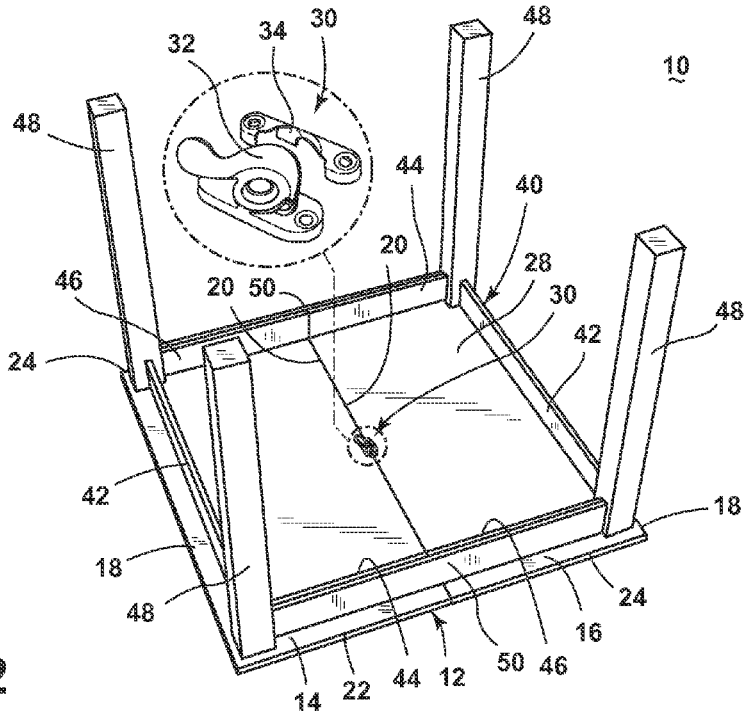
FIG. 2 is a perspective view of the table of FIG. 1 in an inverted position.

FIG. 1 shows an upper side 26 of the tabletop 12, while a lower side 28 of the tabletop 12 can be seen in FIG. 2 with the table 10 inverted. A fastener 30 mounted to the lower side 28 of the first and second tabletop portions 14, 16 along the mating edges 20 and actuable between fastened and unfastened states selectively couples the first and second portions 14, 16. The fastener 30 can be any suitable mechanical fastener, and the fastener of the illustrated embodiment comprises a latch 32 on the first portion 14 and a corresponding keeper 34 on the second portion 16. FIG. 2 shows the fastener 30 in the fastened state with the table 10 assembled, and FIG. 3 depicts the fastener in the unfastened state.

Figure 3:
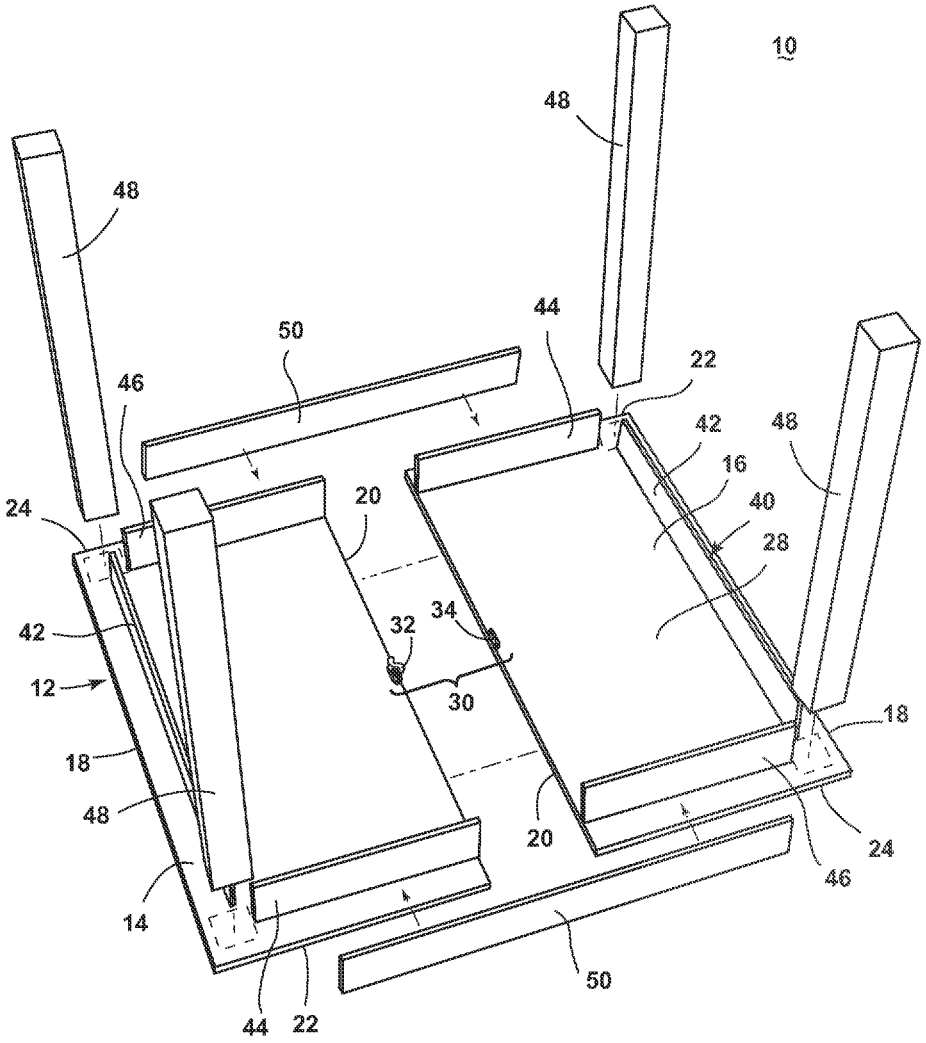
FIG. 3 is an exploded view of the table of FIG. 1 in the inverted position of FIG. 2.

FIG. 3 is an exploded view of the table 10 and also illustrates the individual components and sub-assemblies of the table 10 in the disassembled condition. In addition to the tabletop 12, the table 10 comprises an apron 40 depending from the lower side of the tabletop 10. While the apron 40 can have any suitable configuration, the apron 40 of the exemplary embodiment includes, on each of the first and second portions 14, 16, three separate panels, an end panel 42 and a pair of side panels 44, 46 adjacent to and spaced from the end edge 18 and the side edges 22, 24, respectively. Further, the end panel 42 and the side panels 44, 46 are spaced from each other near the corners of the tabletop 12 to accommodate supporting legs 48. The other ends of the side panels 44, 46 extend to the mating edge 20 so that the panels 44, 46 on the first portion 14 abut the complementary panels 46, 44 on the second portion 16 in a generally coplanar relationship when the table 10 is assembled. The apron 40 can be preassembled to the first and second tabletop portions 14, 16 such that the tabletop 12 and the apron 40 are supplied as sub-assemblies; in the illustrated embodiment, the first tabletop portion 14 and its apron panels 42, 44, 46 form one subassembly, and the second tabletop portion 16 and its apron panels 42, 44, 46 form another subassembly.

Optionally, the table 10 can include a pair of auxiliary aprons 50 mountable to the abutting side panels 44, 46 when the table 10 is assembled. The auxiliary apron 50 overlies the abutting side panels 44, 46 to conceal the seam therebetween and also provides structural rigidity to the table 10 when assembled. The auxiliary apron 50 can have any suitable configuration and is shown as having the same size and shape of the underlying abutting side panels 44, 46.

As previously mentioned, legs 48 support the tabletop 12 when the table 10 is in the assembled condition. The legs 48 are mountable to the lower side 28 of the tabletop 12 in the spaces between the end panel 42 and adjacent side panels 44, 46 of the apron 40. The legs 48, while shown as having a generally square cross-section throughout the entire length of the leg 48, may have any suitable configuration, including legs having arcuate, irregular, and varied cross-sections. Further, the table 10 can have any suitable number of legs 48, with the current embodiment having four of the legs 48 for exemplary purposes.

Figure 4:
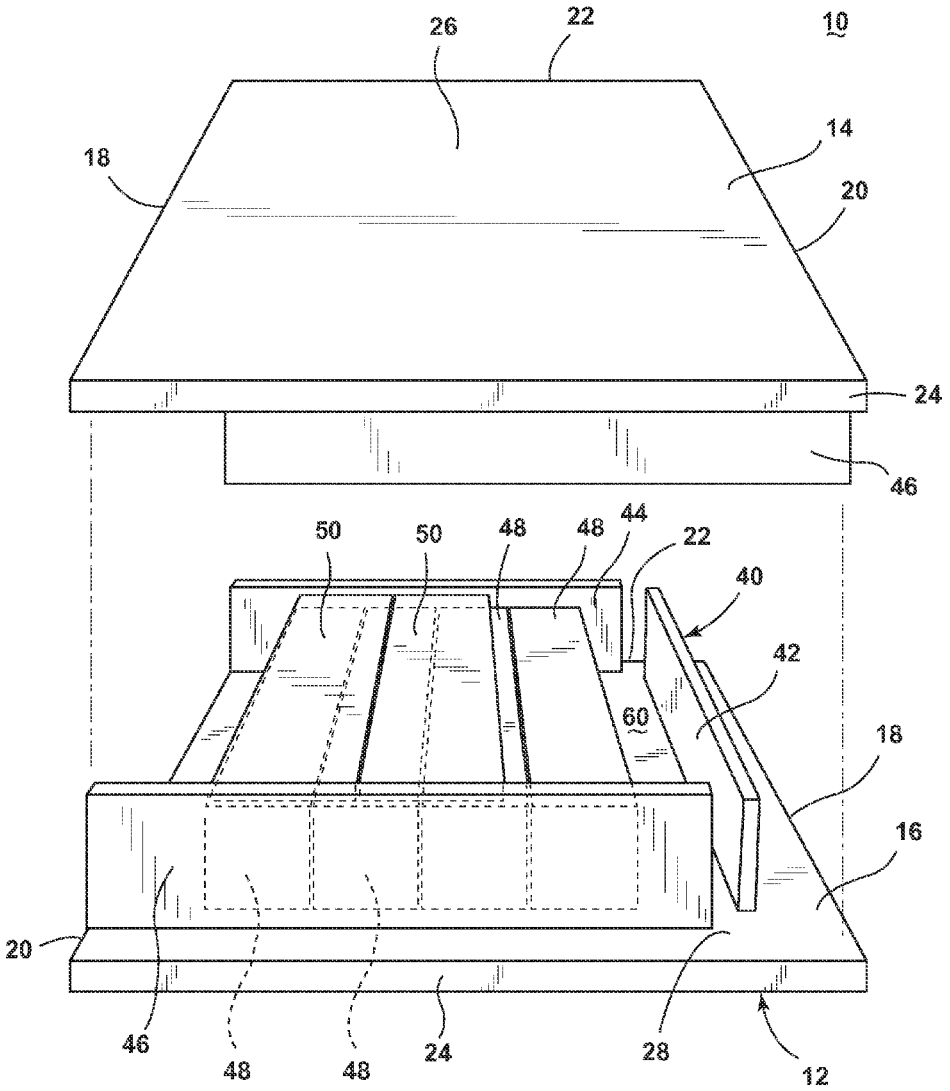
FIG. 4 is a perspective view of the table of FIG. 1 in a disassembled and packed condition with a first portion of the split tabletop shown as exploded from the rest of the table components.
Figure 5:
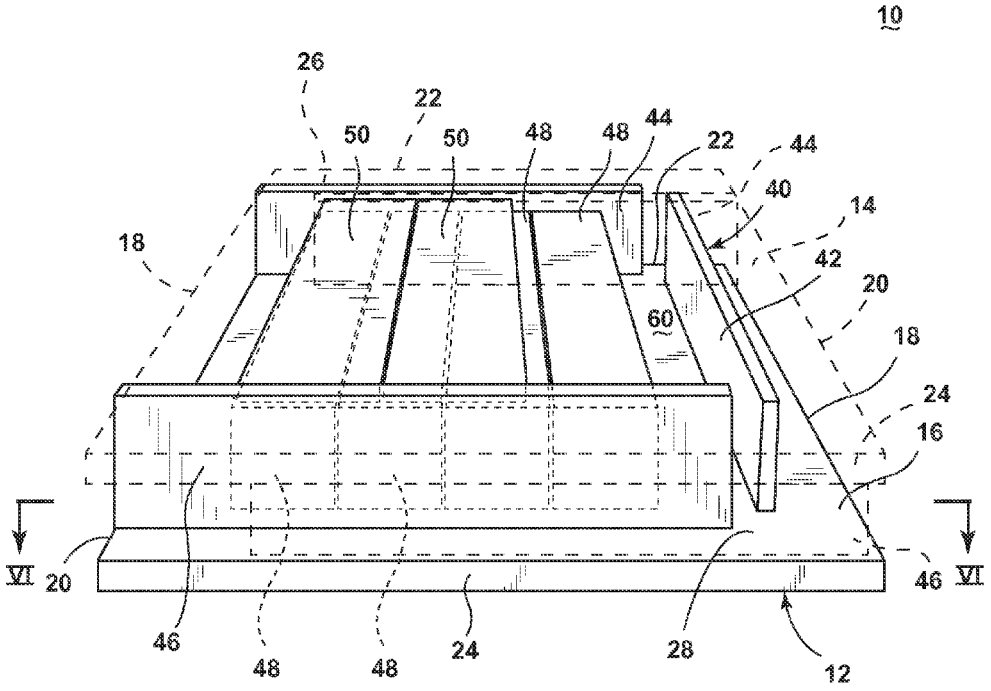
FIG. 5 is a perspective view of the table of FIG. 1 in the disassembled and packed condition with the first portion of the split tabletop shown in phantom.
Figure 6:
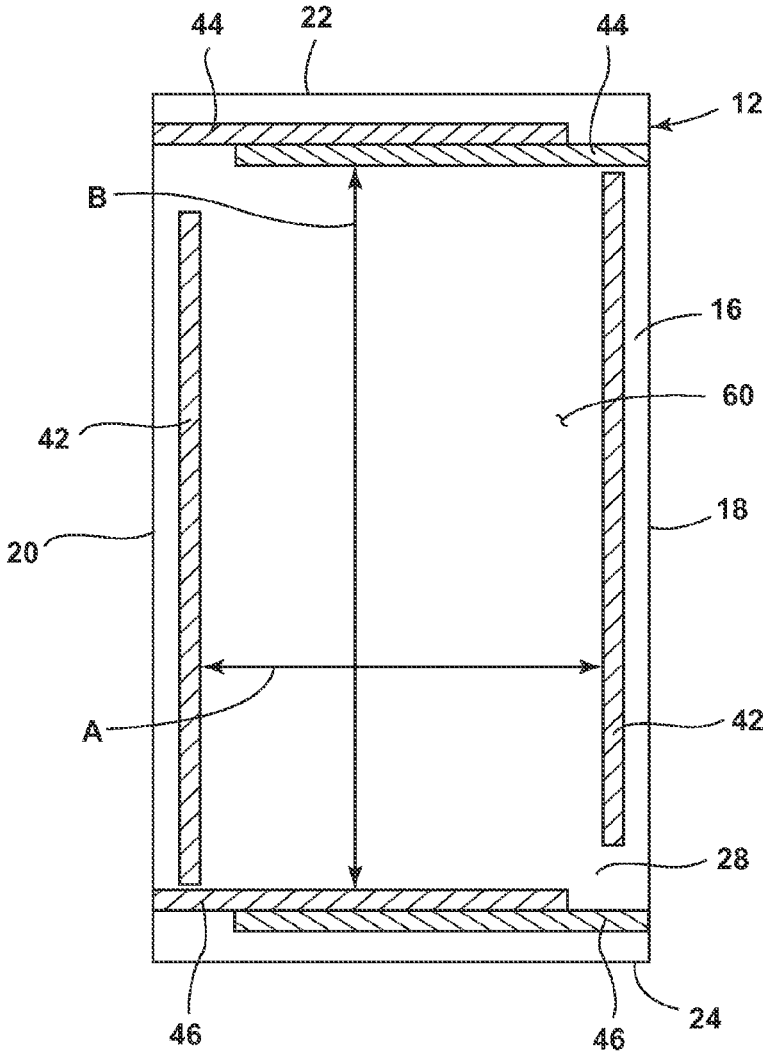
FIG. 6 is a sectional view taken along line VI-VI of FIG. 5 with components removed to better illustrate a cavity for holding them.

The table 10 in the disassembled condition can be compactly packaged. For example, the table 10 when disassembled includes the first tabletop portion 14 and its apron 40 as a first subassembly, the second tabletop portion 16 and its apron as a second subassembly, the legs 48 as individual components, the auxiliary aprons 50 as individual components, and the fastener 30 either mounted to the first and second tabletop portions 14, 16 or provided in a hardware package. These subassemblies and individual components can be arranged relative to one another in a packaged condition to minimize the volume of the disassembled table 10. As shown in FIG. 4, the first subassembly and the second subassembly are vertically stacked with the first subassembly inverted and laterally shifted or offset relative to the second subassembly. FIG. 4 illustrates the first subassembly as exploded from the second subassembly, and FIG. 5 provides a similar illustration with the first subassembly in phantom. The end edge 18 of the first tabletop portion 14 generally vertically aligns with the mating edge 20 of the second tabletop portion 16 and vice-versa, the side edges 22 generally align vertically with each other with an offset due to the offset of the first subassembly, and the side edges 24 generally align vertically with each other with an offset due to the offset of the first subassembly. The sectional view of FIG. 6 best illustrates the orientation of the apron panels 42, 44, 46 for the first and second tabletop portions 14, 16 in the stacked configuration. The end panels 42 oppose one another along a first dimension A while the side panel 44 of the first tabletop portion 14 and the side panel 46 of the second tabletop portion 16 oppose one another along a second dimension B. The space between the end panels 42 and the side panels 44, 46 forms a cavity 60 sized to receive other individual components of the table 10, namely the legs 48 and the auxiliary aprons 50 of the exemplary embodiment and, optionally, a hardware package, tools, and instructions (not shown). In particular, the cavity 60 is defined by the distance between the end panels 42 in the first dimension A, the distance between the side panels 44, 46 in the second dimensions A, B, and the distance between the first and second tabletop portions 14, 16 in the third dimension. The legs 48 and the auxiliary aprons 50 are not illustrated in FIG. 6 to better illustrate the cavity 60. Alternatively, the subassemblies could be offset in the opposite lateral direction such that the cavity 60 would be defined between the side panel 44 of the second tabletop portion 16 and the side panel 46 of the first tabletop portion 14 in the second dimension B. With the disassembled table 10 arranged in the packaged condition, the table 10 is compact and relatively easy to box and handle, both by shipping from the manufacturer to a store and by a consumer purchasing the table 10 in a store.

Figure 7:
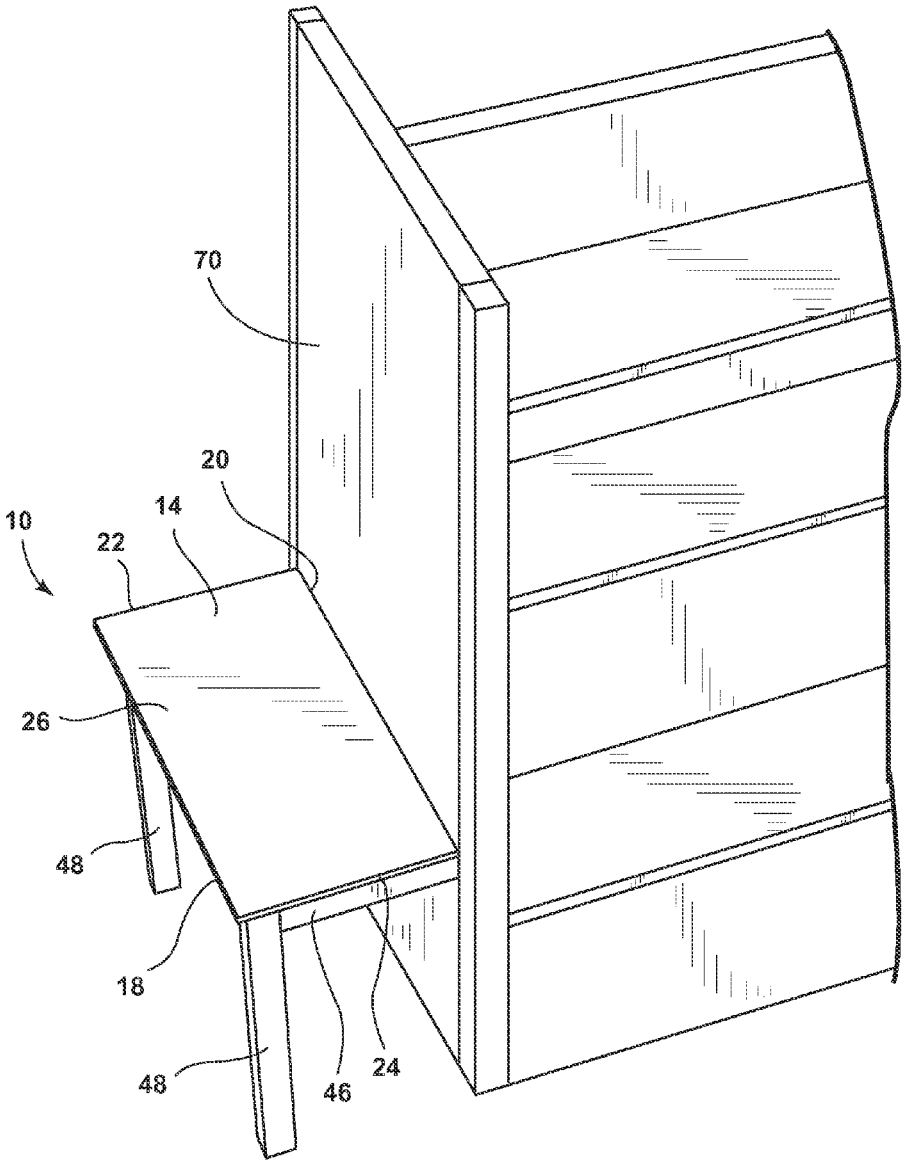
FIG. 7 is a perspective view of a portion of the table assembled and arranged on a display.

The table 10 can be assembled in any suitable order, such as by coupling the first and second tabletop portions 14, 16 with the fastener 30, mounting the legs 48 to the first and second tabletop portions 14, 16, and affixing the auxiliary aprons 50. Alternatively, the assembly may begin with building essentially two separate and independent partial tables by mounting the legs 48 to the separate first and second tabletop portions 14, 16 with their aprons 40, followed by coupling the two partial tables by the fastener 30, and finally affixing the auxiliary aprons 50. The partial table, as shown in FIG. 7, can advantageously be mounted to a standard store gondola 70, such as at the endcap of a gondola, along the mating edge 20 for display.

The table 10 can be modified in any suitable decorative or structural manner. For example, the table 10 may include tabletop leaves or panels between the first and second tabletop portions 14, 16 to increase the size of the tabletop 12. Further, the apron 40 may be configured to define a different size and/or shape cavity 60 to accommodate a different number or type of individual components.

While the invention has been specifically described in connection with certain specific embodiments thereof, it is to be understood that this is by way of illustration and not of limitation, and the scope of the appended claims should be construed as broadly as the prior art will permit.

What is claimed is:

1. A ready-to-assemble table comprising:

a split tabletop having first and second separable portions;

an apron depending from each of the first and second separable portions comprising an end panel and a pair of side panels spaced from each other by spaces near corners of the separable portions; and legs to support each separable portion on a surface;

wherein when the table is in a disassembled condition, the first and second separable portions with their respective aprons can be stacked with one of the first and second separable portions inverted so that the aprons space the first and second separable portions from each other, and the pair of side panels on each separable portion extend through the spaces to be adjacent each other with the aprons offset and the first and second separable portions aligned to form a cavity sized to receive the legs for packaging of the table in a compact assembly.

2. The ready-to-assemble table of claim 1 wherein each of the first and second separable portions comprises a mating edge, an end edge opposite the mating edge, and opposite side edges joining the mating and end edges, and the panels depend from the separable portion adjacent the end edge and the opposite side edges.

3. The ready-to-assemble table of claim 2 wherein when the table is in the disassembled condition with the separable portions stacked, the first and second separable portions are oriented with the mating edge of one of the first and second tabletop portions generally aligned with the end edge of the other of the first and second separable portions such that apron panels adjacent the end edges are spaced from each other to define one dimension of the cavity.

4. The ready-to-assemble table of claim 3 wherein the apron panels adjacent the opposite side edges on the first and second separable portions define a second dimension of the cavity.

5. The ready-to-assemble table of claim 4 wherein when the table is in the disassembled condition with the first and second separable portions stacked, the first and second separable portions are laterally offset relative to each other.

6. The ready-to-assemble table of claim 2, further comprising a fastener mounted to the first and second separable portions and actuable to selectively couple the first and second separable portions.

7. The ready-to-assemble table of claim 6 wherein the fastener is mounted adjacent the mating edges to couple the first and second separable portions with the mating edges in abutting relationship when the table is in an assembled condition.

8. The ready-to-assemble table of claim 7 wherein when the table is in the assembled condition, the apron panels adjacent the side edges of one of the first and second separable portions abut the complementary apron panels on the other of the first and second tabletop portions, and the table further comprises an auxiliary apron mountable to each set of the abutting apron panels.

9. The ready-to-assemble table of claim 8 wherein the cavity formed by the first and second separable portions when in the stacked configuration is sized to further receive the auxiliary aprons.

10. The ready-to-assemble table of claim 7 wherein the fastener comprises a latch mounted on one of the first and second separable portions and a keeper mounted on the other of the first and second separable portions.

11. The ready-to-assemble table of claim 2 wherein the apron panels on each of the first and second separable portions adjacent the side edges are spaced from the apron panel adjacent the end edge to accommodate a leg between the adjacent apron panels.

12. A table comprising:

a first subassembly comprising a first tabletop and an apron mounted to the first tabletop;

a second subassembly separate from the first subassembly and comprising a second tabletop and an apron mounted to the second tabletop; and a fastener mounted to the first and second tabletops and selectively actuable to couple the first and second tabletops to form an assembled full table;

wherein the first and second subassemblies are configured to be vertically stacked with the first subassembly inverted and laterally shifted relative to the second subassembly with the aprons adjacent each other to minimize a volume of the disassembled table;

wherein each of the aprons comprises an end panel and a pair of side panels spaced from each other, and wherein when the table is in the assembled condition, the apron of one of the first and second partial tables abuts the apron on the other of the first and second partial tables with a seam therebetween, and the table further corn rises an auxiliary apron mountable over the abutting aprons to conceal the seam.

13. A ready-to-assemble table comprising:

a split tabletop having first and second separable portions, each of the first and second separable portions having a mating edge, an end edge opposite the mating edge, and opposite side edges joining the mating and end edges;

an apron on each of the first and second separable portions including panels depending from the separable portion adjacent the end edge and the opposite side edges; and legs for the first and second separable portions to support the split tabletop on a surface;

wherein when the table is in a disassembled condition, the first and second separable portions with their respective aprons can be stacked with one of the first and second tabletop portions inverted so that the aprons space the first and second tabletop portions to form a cavity therebetween sized to receive the legs for packaging of the table, and the first and second tabletop portions are oriented with the mating edge of one of the first and second tabletop portions generally aligned with the end edge of the other of the first and second tabletop portions such that apron panels adjacent the end edges are spaced from each other to define one dimension of the cavity, and the apron panels adjacent the opposite side edges on the first and second tabletop portions define a second dimension of the cavity with the first and second tabletop portions laterally offset relative to each other.

14. The ready-to-assemble table of claim 13 further comprising a fastener mounted to the first and second tabletop portions adjacent the mating edges and actuable to selectively couple the first and second separable portions with the mating edges in abutting relationship, wherein when the table is in the assembled condition, the apron panels adjacent the side edges of one of the first and second tabletop portions abut the complementary apron panels on the other of the first and second tabletop portions, and the table further comprises an auxiliary apron mountable to each set of the abutting apron panels.

15. The ready-to-assemble table of claim 14 wherein the cavity is sized to further receive the auxiliary aprons.

16. A table comprising:

a first partial table comprising a first tabletop and a pair of legs mounted to the first tabletop;

a second partial table separate from the first partial table and comprising a second tabletop and a pair of legs mounted to the second tabletop; and a fastener mounted to the first and second tabletops and selectively actuable to couple the first and second tabletops to form an assembled full table;

wherein each of the first and second partial tables comprises an apron depending from the respective first and second tabletops and when the table is in the assembled condition, the apron of one of the first and second partial tables abuts the apron on the other of the first and second partial tables with a seam therebetween, and the table further comprises an auxiliary apron mountable over the abutting aprons to conceal the seam.

* * * * *

UNITED STATES PATENT AND TRADEMARK OFFICE

CERTIFICATE OF CORRECTION

PATENT NO. : 9,173,484 B2
APPLICATION NO. : 14/201190
DATED : November 3, 2015
INVENTOR(S) : Mark V. Miller and Douglas P. Krieger It is certified that error appears in the above-identified patent and that said Letters Patent is hereby corrected as shown below:

In the Claims

Col. 5, line 46 (claim 12), "corn rises" should be "comprises"

Signed and Sealed this
Ninth Day of August, 2016

Michelle K. Lee

Michelle K. Lee
*Director of the United States Patent and Trademark Office*